United States Patent [19]

Mozzi et al.

[11] 4,185,834

[45] Jan. 29, 1980

[54] WORD FORMING GAME

[76] Inventors: Catherine M. C. Mozzi; Helmut Mozzi, both of 32/6-14 Darley St., Darlinghurst, Sydney, New South Wales, Australia, 2010

[21] Appl. No.: 916,465

[22] Filed: Jun. 19, 1978

[30] Foreign Application Priority Data

Jun. 30, 1977 [AU] Australia ..... PD0640

[51] Int. Cl.[2] ..... A63F 3/00

[52] U.S. Cl. ..... 273/241; 273/272; 273/288

[58] Field of Search ..... 273/272, 153 R, 156, 273/157 R, 241, 288; 35/35 R, 35 H, 35 J, 71

[56] References Cited

U.S. PATENT DOCUMENTS

| | | | |
|---|---|---|---|
| 1,605,825 | 11/1926 | Fekete | 35/71 |
| 1,613,204 | 1/1927 | Smith | 273/153 R |
| 2,055,159 | 9/1936 | Scofield | 273/153 R X |
| 3,117,789 | 1/1964 | Wiebe | 273/272 |

FOREIGN PATENT DOCUMENTS

| | | | |
|---|---|---|---|
| 373348 | 5/1932 | United Kingdom | 35/35 H |
| 782890 | 9/1957 | United Kingdom | 273/272 |

*Primary Examiner*—Anton O. Oechsle

[57] ABSTRACT

The invention relates to a word-forming game kit which contains a playing board bearing a grid of rectangles, a number of blank playing tiles and a number of lettered playing tiles which together represent most or all of the alphabet. Each lettered playing tile has on at least one face a minimum of two different letters of the alphabet and may bear up to six letters of the alphabet. The game kit is used to play a cross-word type game in which all the rectangles in the grid are filled by the end of the game. The game is won by the player who can claim the greatest number of tiles at close of play.

8 Claims, 13 Drawing Figures

*Fig. 10*

| | 1 | 2 | 3 | 4 | 5 | 6 | 7 | 8 |
|---|---|---|---|---|---|---|---|---|
| A | AGMNU | LMS | CMNOS | BKOZ | ABMRU | FPY | | |
| B | AFHIT | | | | | | | |
| C | ACDMRU | | | | | | | |
| D | IKM | ABMN | CINW | ALW | BMTU | DPRS | CES | |
| E | ANT | | | | | | | |
| F | EGKM | | | | | | | |
| G | DMRUV | | | | | | | |
| H | | | | | | | | |

*Fig. 11*

| | 1 | 2 | 3 | 4 | 5 | 6 | 7 | 8 |
|---|---|---|---|---|---|---|---|---|
| A | AGMNU | LMS | CMNOS | BKOZ | ABMRU | FPY | | |
| B | AFHIT | CLM | | | | | | |
| C | ACDMRU | DEI | | | | | | |
| D | IKM | ABMN | CINW | ALW | BMTU | DPRS | CES | |
| E | ANT | CDKM | | | | | | |
| F | EGKM | AEF | | | | | | |
| G | DMRUV | GMRS | | | | | | |
| H | | | | | | | | |

*Fig. 12*

| | 1 | 2 | 3 | 4 | 5 | 6 | 7 | 8 |
|---|---|---|---|---|---|---|---|---|
| A | AGMNU | LMS | CMNOS | BKOZ | ABMRU | FPY | | |
| B | AFHIT | CLM | | | | | | |
| C | ACDMRU | DEI | ADET | CFMR | | | | |
| D | IKM | ABMN | CINW | ALW | BMTU | DPRS | CES | |
| E | ANT | CDKM | | | | | | |
| F | EGKM | AEF | | | | | | |
| G | DMRUV | GMRS | | | | | | |
| H | | | | | | | | |

*Fig. 13*

| | 1 | 2 | 3 | 4 | 5 | 6 | 7 | 8 |
|---|---|---|---|---|---|---|---|---|
| A | AGMNU | LMS | CMNOS | BKOZ | ABMRU | FPY | | |
| B | AFHIT | CLM | DRT | | | | | |
| C | ACDMRU | DEI | ADET | CFMR | | | | |
| D | IKM | ABMN | CINW | ALW | BMTU | DPRS | CES | |
| E | ANT | CDKM | ALW | | | | | |
| F | EGKM | AEF | BHI | | | | | |
| G | DMRUV | GMRS | CMNOS | | | | | |
| H | | | GMRSU | | | | | |

WORD FORMING GAME

BACKGROUND OF THE INVENTION

This invention relates generally to a game of the board-and-playing pieces type; more specifically, the invention relates to a word forming game played on a game board, preferably by two players or teams.

It can be said of many games that any skills acquired while playing them have little or no obvious application outside the particular sphere of each game. Also, because these skills are so specialised it is generally a foregone conclusion that an experienced player will defeat an inexperienced opponent, regardless of education or intellect. Thus while the minds of players may be stimulated, many games are no more than a pastime and have little educational value.

The foregoing does not apply in the case of word forming games, which develop skills which are extremely useful in other spheres while at the same time providing intellectual stimulation. In addition, the matching of players in word forming games does not depend on any specialised skill but rather on the standard of education and vocabulary of each player.

There are a number of word forming games already in existence. Generally, these prior art games are of two types. The first type uses single letters to form words. The second type does the same with syllables. Both types offer only limited possibilities for forming meaningful words. This means that players often have to resort to the making-up of words of order to carry on play. Such procedure naturally defeats the purpose of such games, which is to give a player the opportunity to apply the whole range of his vocabulary.

SUMMARY OF THE INVENTION

The present invention overcomes these shortcomings by providing a word-forming game kit which consists of: a playing field having marked thereon a grid of discrete areas, a plurality of blank playing tiles and a plurality of lettered playing tiles, the lettered playing tiles together representing at least a substantial portion of the alphabet, each discrete area on the playing field being dimensioned to accommodate a single playing tile only, characterised in that each lettered playing tile bears on at least one face thereof a minimum of two different letters of the alphabet.

The playing field used in the game kit of this invention may consist of any suitable material, for example cardboard, plastic, wood or metal, or even paper. But preferably the playing field is a game board formed from a light and rigid material such as plastic, ideally formed by plastic injection moulding. The playing field may also be made up from separate strips of materials, for instance, cardboard, plastic, wood or metal to facilitate placing of the playing tiles as described hereinbelow.

The grid of discrete areas is preferably a grid pattern of 144 rectangles arranged in twelve rows of twelve rectangles each. While this type of configuration can be accommodated on a flat surface, it is highly desirable that the playing field permits the placement of the playing tiles in such a manner that the tiles cannot easily be moved inadvertently during play. At the same time, the playing tiles must be easy to place, pick up and turn over when necessary. To satisfy the above requirements the playing field in a preferred embodiment of this invention has a series of latitudinal ridges, each adjacent pair of ridges defining latitudinal limits of one row of discrete areas in the grid. Optionally, longitudinal ridges define longitudinal limits of columns of discrete areas in the grid.

The number of blank tiles can vary according to the number of discrete areas in the grid and the complexity of the game. Where the game is intended for use by children for example, it may be advantageous to supply a greater number of blank tiles than in the case of a game intended for use by adults. Preferably the game kit of this invention includes a number of blank playing tiles corresponding to approximately one-third or one-quarter of the number of discrete areas in the grid.

While each lettered playing tile must bear a minimum of two different letters of the alphabet, the total number of letters can vary from tile to tile and letter combinations ranging from 2 to 6 letters in length may be employed, for example.

It is from any of these combinations of two or more different letters that a player chooses a letter for the purpose of forming a word during play; variations of this theme will be apparent to one skilled in the art and are within the scope of this invention.

Each lettered tile preferably has the same letters on opposing faces of the tile. In addition it is desirable that the background colour of one lettered face is different from the background colour of the opposing lettered face, in order to facilitate scoring after a game has been played as explained with reference to the drawings, below. The number of lettered playing tiles ideally exceeds the total number of discrete areas in the grid.

Both lettered and blank playing tiles should be made from a material which is fairly rigid and which permits printing and stamping out or cutting on a large scale. An especially preferred playing tile material is plastic.

The game kit of this invention will now be described with reference to one embodiment thereof as illustrated in the attached drawings, which are not, however, to be taken as limiting on the scope of the invention.

BRIEF DESCRIPTION OF THE DRAWINGS

In the drawings:

FIGS. 8 to 13 are a series of plan views of part of a single game board, on which consecutive stages of a sample game are recorded.

DETAILED DESCRIPTION OF THE INVENTION

Figure 1:
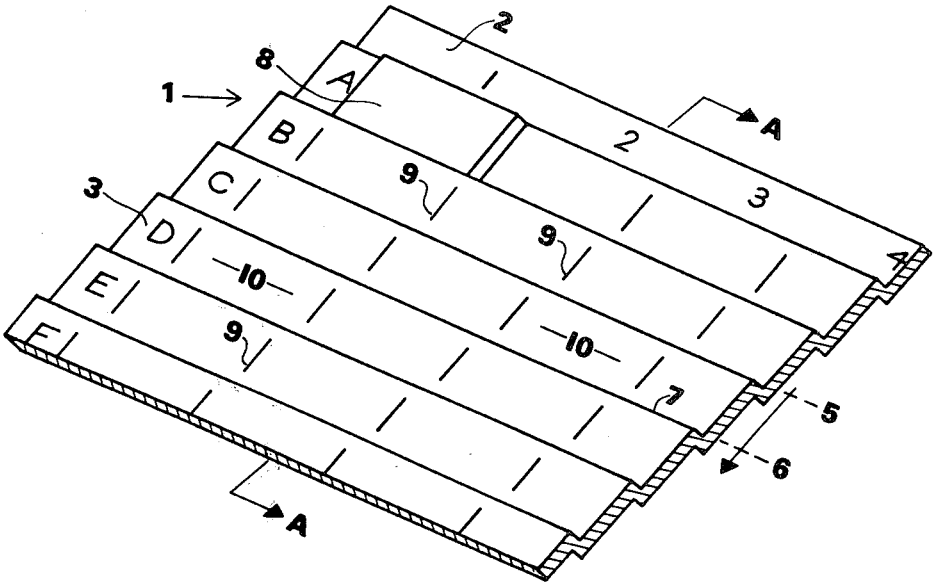
FIG. 1 is a perspective view of part of the game board, with one tile (blank or lettered) placed thereon.
Figure 7:
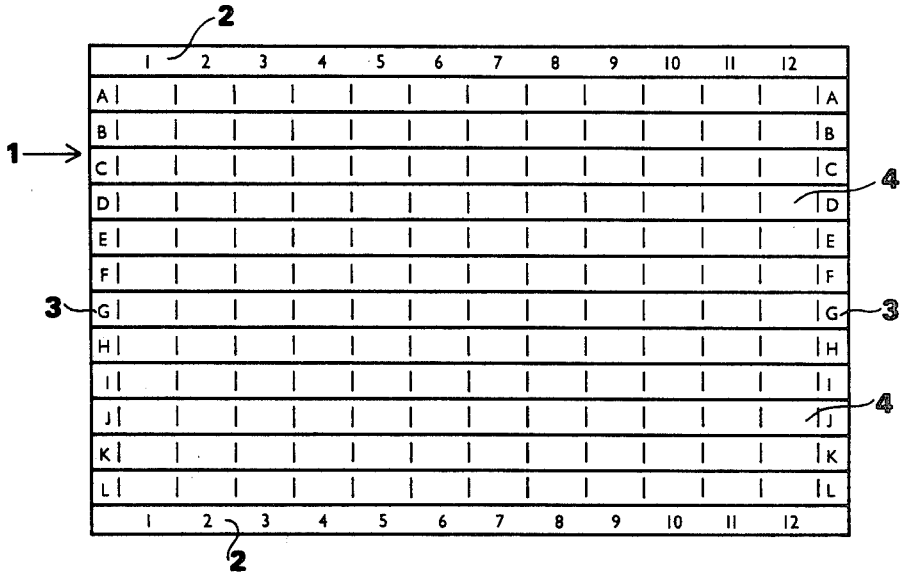
FIG. 7 is a plan view of the game board shown in part in FIG. 1, before placement of a pattern of blank tiles.

The game board 1, partially shown in FIG. 1 and fully shown in FIG. 7, is basically a grid pattern of one hundred and forty-four rectangles arranged in twelve rows of twelve rectangles each. These rows are numbered across from one to twelve in the top and bottom margins 2, and lettered downwards from A to L in both side margins 3.

Figure 2:
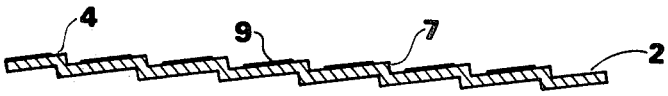
FIG. 2 is a sectional view of the game board of FIG. 1 taken along the lines A—A of FIG. 1.

To inhibit inadvertent movement of playing tiles during play, the surface of the board is latitudinally divided into twelve strips 4 (see FIG. 2), consistent with the twelve latitudinal rows of the basic grid pattern. Each of these strips is individually sloped downwards as indicated by the arrow on the line 5–6 in FIG. 1. The gradient of slope is the same for each strip. The lower edge of each strip adjoins the upper edge of the strip next to it, resulting in a step 7 approximately one and one-half times the thickness of a tile 8. When any tile is placed on any one of the strips it will slope downwards with its lower edge resting against the step 7 formed by the upper edge of the adjoining strip, as illustrated in FIG. 1. The strips are lettered downwards from A to L in both side margins 3, consistent with the basic grid pattern.

Longitudinally the grid pattern is constituted by fine ridges 9, demarcating discrete areas 10 and for holding the tiles 8 in place laterally. To allow the longitudinal rows of the grid pattern to be numbered across from one to twelve, two narrow strips are added as top and bottom margins 2, the bottom strip also providing the step 7 along the lower edge of the strip lettered L.

It will be appreciated that the longitudinal divisions could be indicated by simple lines or grooves instead of by ridges 9. However these would have the disadvantage of not holding the tiles laterally.

Figure 3:
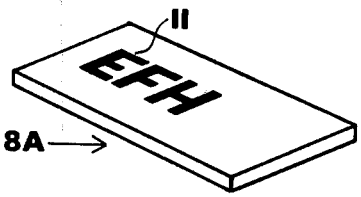
FIG. 3 is a perspective illustration of a first lettered tile.

FIG. 3 shows a lettered tile 8A, with a letter combination 11. From this letter combination a player chooses any one letter when forming a word.

In a game with a grid pattern of 144 rectangles there are preferably approximately one hundred different letter combinations represented, with two copies of each tile, resulting in a total of approximately two hundred lettered tiles. The combined letter combinations offer a well-balanced representation of all letters of the alphabet for filling the grid pattern with words spanning the whole of the English vocabulary. In addition, the rules of this embodiment provide that any lettered tile may be used as the letters "Q" or "QU" or "X".

Figure 4:
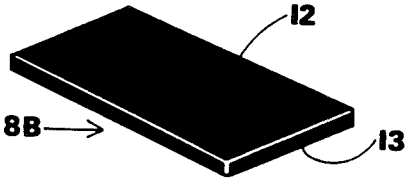
FIG. 4 is a perspective illustration of a blank tile.

FIG. 4 illustrates a blank playing tile 8B. In this embodiment, the game kit of the invention includes approximately forty blank tiles 8B, being of the same dimensions as the lettered tile 8A but a solid colour such as black on both broad faces 12 and 13.

Figure 5:
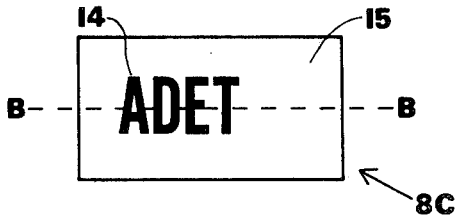
FIG. 5 is a plan view of a second lettered tile.
Figure 6:
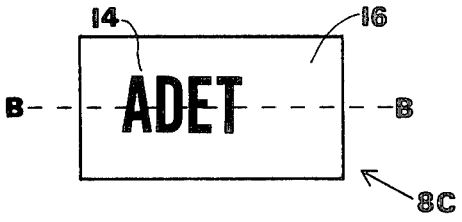
FIG. 6 is a plan view of the tile of FIG. 5 rotated through 180 degrees round the axis B—B of FIGS. 5 and 6.

FIGS. 5 and 6 show opposing faces of a lettered tile 8C, being similar to tile 8A but having a different letter combination 14. The view of tile 8C in FIG. 6 is obtained by rotating the tile of FIG. 5 through 180° around axis B—B. Background 15 of the face of FIG. 5 is a different colour from background 16 of the face of FIG. 6. It has been found that rotation of a tile 8 placed on board 1 is facilitated by gently pressing the tile against step 7.

FIGS. 8 to 13 are a series of plan views of part of the same game board 1, showing consecutive stages of a sample game. A method of playing the game of the invention will now be described, followed by a more detailed example of actual play in conjunction with FIGS. 8 to 13. It is, however, to be appreciated that the game kit of the invention can be used to play variations of the game described.

Broadly, two players or teams of players take turns at forming words by placing tiles on horizontally- or vertically-adjoining discrete areas of the grid on the game board.

Before play commences, the players or teams decide on which of the two colours on opposing faces of lettered tiles will represent each player or team. Then the players lay out a crossword-like pattern of blank tiles on the grid. The pattern can be chosen from a set of patterns supplied with the game kit or it can be devised by the players. The movable blank tiles allow many different patterns to be laid out, making the game even more interesting and giving it various degrees of difficulty. Generally speaking, the fewer blank tiles there are in the pattern the more difficult the game will be.

Play begins when each player draws fifteen lettered tiles from a pool of tiles. The pool may conveniently be located in a pouch. The fifteen lettered tiles can be placed close to the game board so that each player can conveniently survey his tiles. There is no need for a player to shield his tiles from his opponent.

The first word is to be formed, either horizontally or vertically, beginning in the upper left-hand corner of the grid. However the word formed must occupy all the space between the upper left hand corner (i.e. area A-1 in FIG. 7) and the nearest blank tile in row A or column 1. All subsequent words must incorporate at least one of the lettered tiles already on the board.

A player forming a word is restricted to the choice of letters offered by the 15 lettered tiles in his possession. He also has to consider the letters on the lettered tiles already placed on the board that he may or must incorporate. The words can only be formed horizontally or vertically, not diagonally. They must fill the word spaces between the blank tiles. Only one of the letters in any letter combination can be used in forming a word. Once a lettered tile is part of a word on the game board and another word is formed with it, running perpendicular to the direction of the first one, again any one of the letters in the lettered tile's combination can be chosen. That means, effectively, that a lettered tile can read differently from across to down and that there is no need for remembering the words formed. After each word is formed a player can draw enough lettered tiles from the pouch to compensate for the ones placed.

The challenge in this game is twofold: firstly, it lies in the difficulty a player encounters in finding and forming words fitting into spaces of a given length while he is restricted to the choice of letters on the lettered tiles in his possession and has to incorporate one or more of the lettered tiles already on the game board. Secondly, challenge is provided by the endeavour of both players or teams to have at the end of play more lettered tiles in their colour on the game board than their opponent(s).

As a consequence of the grid pattern, every time a word is formed this is done across other word spaces. Therefore, soon after play has begun, there will be word spaces in which lettered tiles have accumulated. To ensure an even progress of play, players must incorporate any accumulated lettered tiles when forming their words. Players must give priority to accumulated lettered tiles in the following order: a word space with the greatest number of accumulated lettered tiles has first priority; where two or more word spaces have the same number of accumulated tiles, the word space with the most solid formation of accumulated tiles has priority. Thus accumulated tiles of open formation have low priority. Players can choose between word spaces having accumulated lettered tiles of equal priority.

Every time a player forms a word, he is entitled to all the lettered tiles in it, regardless of the number of accumulated lettered tiles incorporated in the process. Thus any tiles incorporated in a player's word are rotated so that the player's colour is uppermost, if that is not the case already. A player has to employ some strategy to try and retain as many as possible of his lettered tiles while, on the other hand, gaining as many as possible from his opponent.

If a player is obliged under the priority rule to fill a certain word space and he finds himself unable to do so, he has to miss that turn and wait for the next one.

If both players or teams are unable to fill a particular word space, they can do one of the following:

1. If the difficulty is caused by a lack of suitable letters on the lettered tiles in both player's possession, the player who made the initial attempt can draw 2 extra lettered tiles from the pouch and try again. If he is still unsuccessful the players alternate at drawing 2 extra lettered tiles until the word space can be filled. After that, a player is not allowed to draw any new lettered tiles until the number in his possession is below 15.

2. If the difficulty is caused by accumulated lettered tiles whose choice of letters does not allow the formation of a word, the player who made the initial attempt can exchange any one of these accumulated lettered tiles. He can do this regardless of the letter for which the tile was originally placed. The replacement tile must be put in the opponent's colour.

Sometimes, because of accumulated lettered tiles, a player forming a word will also fill a short word space running perpendicular to the direction of the first one. He can either ignore this, or he can try to form a word in the second word space as well, if through this he can gain one or more of his opponent's lettered tiles. See FIG. 13, referred to below.

The play finishes with all discrete areas of the game board being occupied. The winner is the player with more lettered tiles in his colour.

Reference will now be made to the playing of a sample game, as illustrated in FIGS. 8 to 13. It will be observed that only the upper left-hand part of the board is shown in these Figures and play is limited to this area. In practice, there is no reason for confining play to the upper left hand area. This has been done for convenience in FIGS. 8 to 13 so that details of the board and playing pieces can be presented on a larger scale than would be possible if the whole of the game board were shown.

The plain lettered tiles represent the black player, and the cross-hatched lettered tiles represent the red player.

Figure 8:
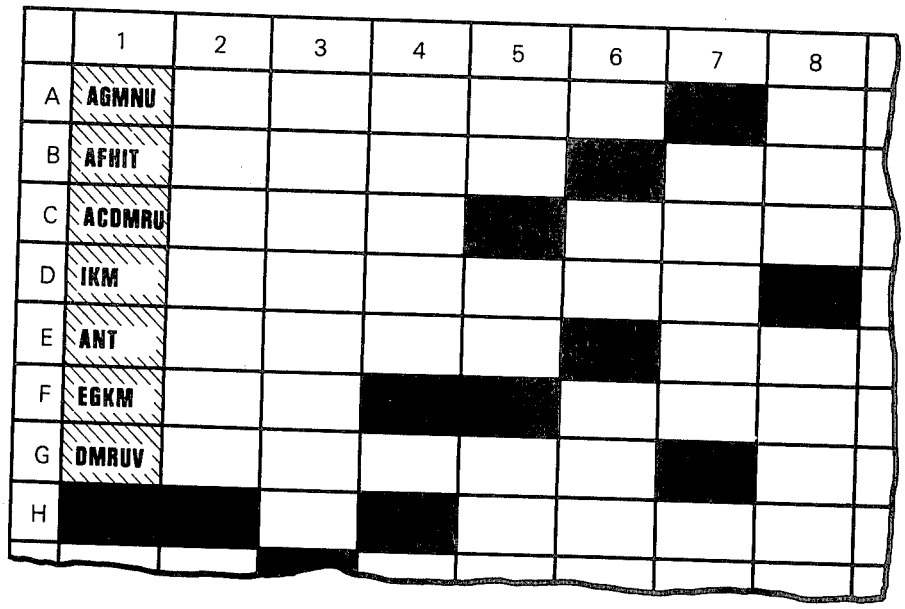

In FIG. 8, the game is commenced by the first player able to form a word in the upper left-hand corner, either horizontally or vertically. Here the red player has formed the word MARINER in the word space A1-G1. The black player has to incorporate in his word one of the lettered tiles placed by the red player.

Figure 9:
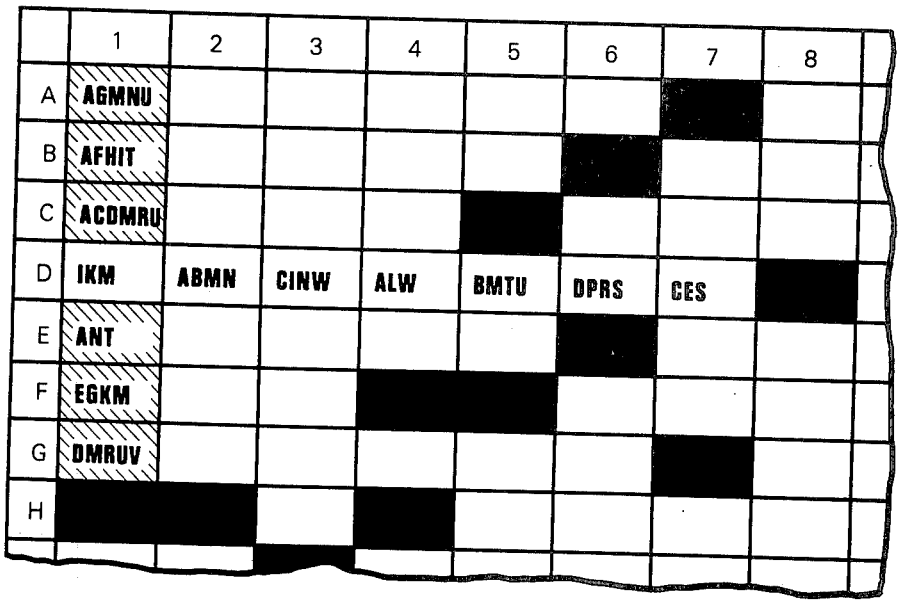

In FIG. 9, the black player has formed the word INCLUDE in the word space D1-D7. The red player must now incorporate in his word one of the lettered tiles already on the board.

In FIG. 10, the red player has formed the word GLOOMY in the word space A1-A6. The black player now has to consider the accumulated lettered tiles in word spaces A2-G2, A3-H3 and A4-E4. All three word spaces contain two accumulated lettered tiles in open formation and, therefore, are of equal priority.

In FIG. 11 the black player has formed the word SLENDER in the word space A2-G2. Word spaces A3-H3 and A4-E4 still contain two accumulated lettered tiles each in open formation. Word spaces B1-B5, C1-C4, E1-E5, F1-F3 and G1-G6 each contain two accumulated lettered tiles in solid formation and therefore the latter group of word spaces have priority over the former group.

In FIG. 12, the red player has formed the word DEER in word space C1-C4. Word spaces B1-B5, E1-E5, F1-F5 and G1-G6 still contain two accumulated lettered tiles each. However word spaces A3-H3 and A4-E4 now contain three accumulated lettered tiles each and therefore have priority.

In FIG. 13, the black player has formed the word CRAWLING in word space A3-H3. At the same time, the black player has filled word space F1-F3 with the word GAB. It was not necessary for the black player to form a word in word space F1-F3 but by doing so he gains the red player's tile in discrete area F1.

Word space A4-E4 contains three accumulated lettered tiles in a semi-solid formation. Word spaces B1-B5, E1-E5 and G1-G6 each contain three accumulated lettered tiles in a solid formation and therefore have priority over space A4-E4.

The game of this invention is designed to force the player to explore the full width of his vocabulary. It is particularly advantageous in bringing to the fore the player's latent vocabulary since he works without clues and therefore has to search a large section of his vocabulary for a word fitting into a given space while incorporating lettered tiles already on the game board. Like all word forming games this game promotes consciousness of cognitive structure and spelling.

In contrast to other word forming games, the multiple choice of letters offered by the lettered tiles, together with the use of blank tiles, allows the game board to be filled solidly at the end of play.

To achieve a flexible degree of difficulty, without detracting from the game's challenge, a number of lettered tiles may carry in their combinations letters that are marked with a dot below them. These letters so marked should be used only if a player thinks he will otherwise be unable to form a word. Use of these marked letters means the loss of the respective lettered tile or tiles to the opponent.

By means of the marked letters and the movable blank tiles the game is suitable for literate players of all ages and backgrounds. It is ideal for purely social play without much competition. It can, of course, also be played very competitively, especially in conjunction with a timing device.

It will be apparent from the foregoing that the present invention represents a considerable advance in the art and is deserving of the grant of Letters Patent.

What is claimed is:

1. A word-forming game kit comprising a playing field having marked thereon a grid of discrete areas, a plurality of blanking playing tiles and a plurality of lettered playing tiles, the lettered playing tiles together representing at least a substantial portion of the alphabet, each discrete area on the playing field being dimensioned to accommodate a single playing tile only, characterized in that each lettered playing tile bears on at least one face thereof a minimum of two different letters of the alphabet and in that a second face of each lettered playing tile is identical to said one face except for background color of said second face.

2. A word-forming game kit as claimed in claim 1 wherein each discrete area of said grid is rectangular and a series of latitudinal ridges on said playing field defines rows of the discrete areas.

3. A word-forming game kit as claimed in claim 2 wherein the number of blank playing tiles is equal to form one-quarter to one-third of the number of discrete areas of said grid.

4. A word-forming game kit as claimed in claim 2 wherein each lettered playing tile bears up to 6 different letters of the alphabet on at least one face thereof.

5. A word-forming game kit as claimed in claim 2 wherein a series of longitudinal ridges on said playing field defines columns of discrete areas.

6. A word-forming game kit as claimed in claim 2 wherein the number of lettered playing tiles exceeds the total number of discrete areas of said grid.

7. A word-forming game kit as claimed in claim 2 wherein said grid of discrete areas is a grid pattern of 144 areas arrnaged in twelve rows of twelve areas each.

8. A word-forming game kit comprising a playing field having marked thereon a grid of discrete areas, a plurality of blank playing tiles and a plurality of lettered playing tiles exceeding the number of discrete areas of said grid, the lettered playing tiles together representing at least a substantial portion of the alphabet, each discrete area on the playing field being dimensioned to accommodate a single playing tile only, each lettered playing tile bearing on opposite faces thereof a minimum of two different letters of the alphabet, the opposite faces of each lettered playing tile being identical except for having different background colors; said playing field being latitudinally divided into a plurality of strips, each of said strips adjoining an upper edge of an adjacent strip so as to define steps between said strips approximately one and one-half times the thickness of the tiles; and fine ridges on said strips for holding tiles on said strips in place laterally and demarcating said discrete areas.

* * * * *

UNITED STATES PATENT AND TRADEMARK OFFICE

CERTIFICATE OF CORRECTION

PATENT NO. :4,185,834

DATED :January 29, 1980

INVENTOR(S) :CATHERINE MARTHE CLAIRE-LISE MOZZI ET AL

It is certified that error appears in the above—identified patent and that said Letters Patent is hereby corrected as shown below:

Claim 1, col. 6, line 55 "blanking" should be --blank--

Signed and Sealed this

*Twenty-third* Day of *September 1980*

[SEAL]

*Attest:*

SIDNEY A. DIAMOND

*Attesting Officer*

*Commissioner of Patents and Trademarks*